US005888061A

United States Patent [19]

Reynolds

[11] Patent Number: 5,888,061

[45] Date of Patent: Mar. 30, 1999

[54] COMBINATION LIGHTER AND CIGAR CUTTER HAVING A DUAL BLADE CUTTING CONSTRUCTION

[75] Inventor: Michael P. Reynolds, Warwick, R.I.

[73] Assignee: Colibri Corporation, Providence, R.I.

[21] Appl. No.: 921,825

[22] Filed: Sep. 2, 1997

[51] Int. Cl.[6] ..... A24F 13/24

[52] U.S. Cl. ..... 431/253; 131/249

[58] Field of Search ..... 431/253, 120; 131/248, 249, 250, 233; 206/85, 86

[56] References Cited

U.S. PATENT DOCUMENTS

| | | | |
|---|---|---|---|
| 4,897,033 | 1/1990 | Yang | 431/253 |
| 5,181,528 | 1/1993 | Chen et al. | 131/256 |
| 5,738,117 | 4/1998 | Fontaine | 431/253 |

*Primary Examiner*—Carl D. Price

*Attorney, Agent, or Firm*—Fish & Richardson P.C.

[57] ABSTRACT

A combination lighter and cigar cutter device for cutting off an end of a cigar and lighting same includes a casing having a body, a lighting mechanism for producing a flame, and a recessed cavity formed in the body, and a cigar cutter having a planar ring member with a central opening and a thin slot formed therein. A pair of thin cutting blades are received within the slot of the ring member, each blade being movable between a first position in which the cutting blades are substantially withdrawn from the opening and a second position in which the cutting blades are completely received within the opening, so as to effect a shearing or cutting action on a cigar positioned in said opening. Each cutting blade has a handle portion secured thereto for easily moving the cutting blades between the first and second positions. The ring member of the cigar cutter is pivotally secured to the casing about a vertical axis for movement between an open operative position and a closed non-use position in which the ring member is disposed snugly within the cavity.

3 Claims, 3 Drawing Sheets

COMBINATION LIGHTER AND CIGAR CUTTER HAVING A DUAL BLADE CUTTING CONSTRUCTION

BACKGROUND AND SUMMARY OF THE INVENTION

This application relates to a variation of the subject matter of Assignee's co-pending case Ser. No. 08/774,757, now U.S. Pat. No. 5,738,117, which pertains to a combination cigar cutter and lighter device having a fold-out single blade cutting construction.

This invention relates generally to cigar paraphernalia and more particularly to a combination lighter and cigar cutter having a swing-out double-blade cutting construction that is capable of both cutting the closed end of a cigar and lighting the cigar after it is cut.

The popularity of cigar smoking in this country has greatly risen over the past couple of years. A typical cigar includes filler tobacco at its center, a binder in the form of a leaf which holds the filler together, and an outer wrapper which is rolled around the binder. This configuration includes all but the thinnest cigars. In a handmade cigar, the filler, and wrapper are combined manually to create the cigar. Such handmade cigars have a closed end or head portion which is received in the smoker's mouth and an open end or foot portion which is lighted by the smoker.

The proper tools for cutting and lighting cigars are accessories that enhance the cigar smoking experience. More specifically, an experienced cigar smoker will leave the head portion of the cigar in its finished, pre-smoked state until the cigar is smoked. This serves to maximize flavor and freshness of the cigar. Before smoking, the smoker cuts the finished head portion with a tool to provide a neat, clean cut. There are a number of different tools presently available for cutting off the closed head portion of the cigar. For example, there are V-shaped cutters, core punchers and slicers, all of which provide a clean cut to ensure proper circulation through the body of the cigar when it is smoked.

In general, the present invention is directed to a combination lighter and cigar cutter device for cutting off an end of a cigar and lighting same. The device comprises a casing having a body, lighting means for producing a flame, a cavity formed in the body, and a cigar cutter having a dual blade guillotine-like cutting construction. More specifically, the cigar cutter comprises a planar ring member with a central opening and a narrow slot formed therein. The narrow slot is formed within the ring member along a plane generally transverse with respect to the opening. A pair of cutting blades are slidably received within the narrow slot of the ring member and are movable between a first position in which the cutting blades are substantially removed from the slot and a second position in which the cutting blades are completely received within the slot to effect a scissors-like cutting action. Each cutting blade has a handle portion attached at its outer edge for easily moving the blades from the first position to the second position when cutting off the end of the cigar. Means of the present invention secures the ring member of the cigar cutter to the casing in a position in which the ring member is disposed within a recessed cavity provided in the casing.

More specifically, the body of the casing is generally box-shaped and has four side walls and an end wall closing one end of the body, the cavity being formed in one of the side walls. The securing means comprises hinge means for hingedly attaching the ring member to the casing between a closed position in which the ring member is received within the cavity of the casing and an open position in which the ring member is pivoted away from the casing. The hinge means comprises a pair of oppositely projecting pins formed on the ring member. The pins are received within apertures formed in side walls adjacent to the side wall having the cavity for achieving the pivotal movement of the ring member with respect to the body of the casing between its closed and open positions. In view of the double cutting action involved, it is important that the hinge axis of the ring member be vertically disposed along an edge of the casing when the latter is in an upright position.

Accordingly, among the several objects of the present invention are: the provision of a combination lighter and cigar cutter device which has a common casing for both cutting and lighting a cigar thereby eliminating the need of having a separate lighter and cutter; the provision of such a device having a uniquely designed swing-out cutter which is movable between an open or operating position and a closed or stowed position in which it lies within a cavity formed in the casing; the provision of such a cutting device that has a dual blade guillotine-like cutting construction; the provision of such a device which is neat and attractive in appearance; and the provision of such a device that is simple in design and easy to manufacture and assemble.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
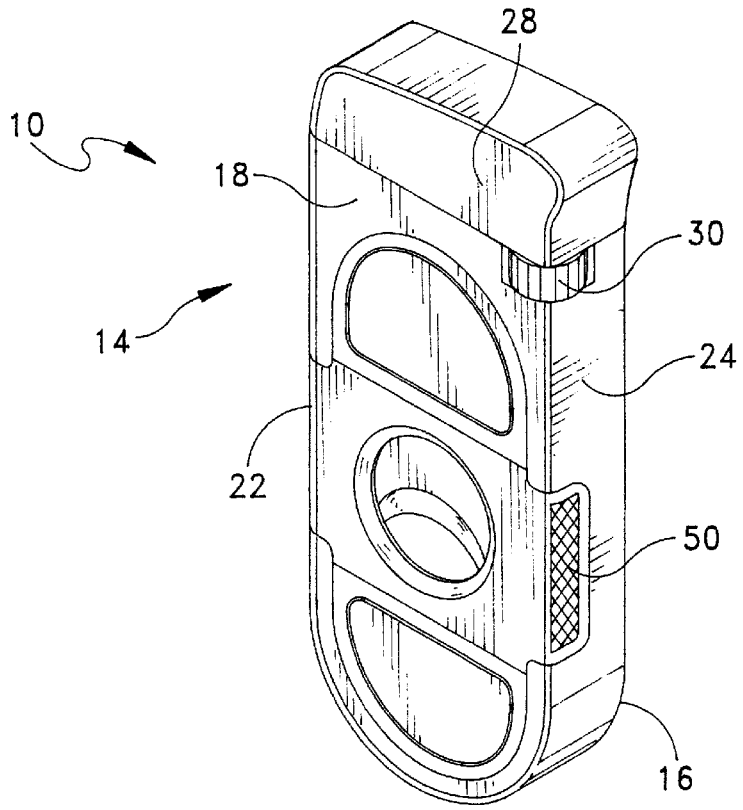
FIG. 1 is a perspective view of the combination lighter and cigar cutter device of the present invention.

Referring now to the drawings, and more particularly to FIG. 1, there is generally indicated at 10 a combination lighter and cigar cutter of the present invention. The device 10 is especially suited for removing the closed head portion of a cigar 12 (FIG. 5), and for lighting the cigar 12 thereafter. The device 10 includes a casing, generally indicated at 14, which houses the necessary elements for performing these two functions. Thus, the present invention eliminates the need of having a cutter, completely separate and distinct from the lighter, for cutting and lighting the cigar 12.

The casing 14 of the device 10 houses the elements necessary for producing a flame. More specifically, the casing 14 has a rectangularly-shaped body 16, the body 16 having four elongate side walls 18, 20, 22 and 24, an end wall 26 which closes one end of the body 16, and a cover 28 which selectively closes the other end of the body 16. The cover 28 is pivotally connected to one of the side walls of the body 16, e.g., side wall 22, for selective movement between the illustrated closed position and an open position (not shown) to access the components necessary for producing the flame. As shown, the casing 14 has an aperture 29 through which a spark generating wheel 30 protrudes. It should be understood that the device 10 of the present invention is constructed similarly to commonly available lighters that are well known in the art.

In this regard, the spark generating wheel 30 is manually rotated, the wheel 30 engaging a flint member (not shown) to generate the sparks that ignite butane released through a fuel nozzle (also not shown) positioned adjacent the wheel 30. The casing 14 further houses a container (also not shown) for storing butane therein. The container is accessed through a one-way valve provided at the end wall 26 of the body 16 of the casing 14.

It should be understood that the flame producing mechanism of the present invention can embody any type of device and still fall within the scope and spirit of the present invention. The present invention is not directed to a novel flame producing mechanism, but to a device 10 which, in one common housing or casing 14, can cut off the head portion of the cigar 12 and also light the cigar.

Figure 2:
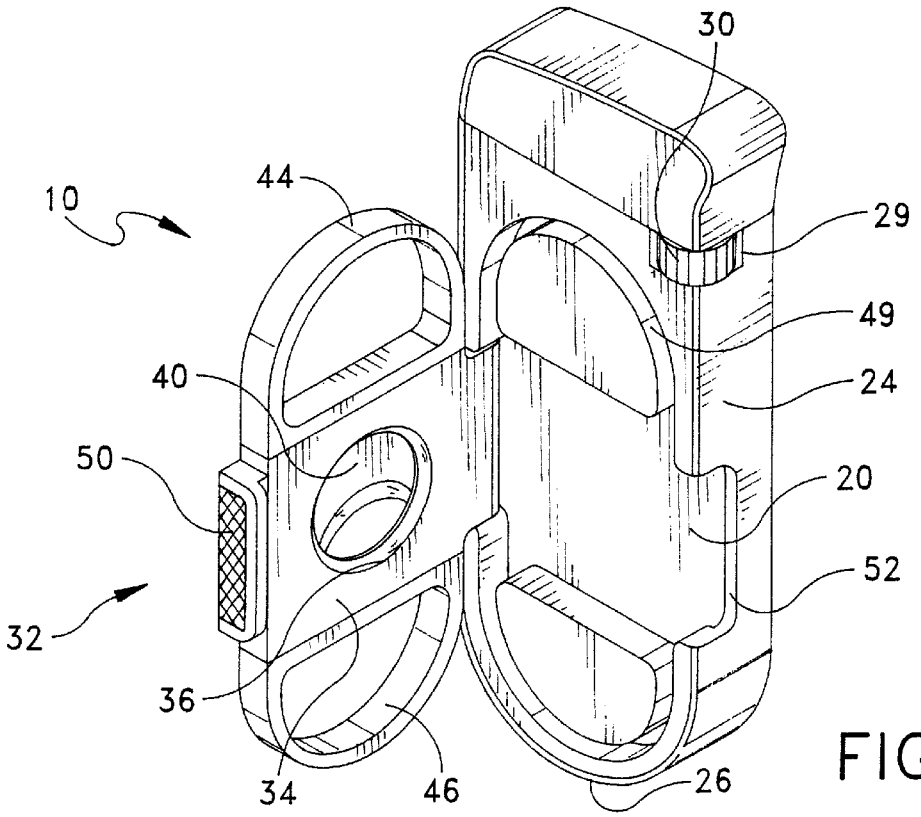
FIG. 2 is a perspective view showing the cigar cuter swung to an open position with the dual cutting blades in a closed position.

Referring now to FIG. 2, the device 10 further comprises a cigar cutter, generally indicated at 32, for cutting the head portion of the cigar 12. As shown, the cigar cutter 32 has a rectangularly-shaped, planar ring member 34 having a relatively large central opening 36 formed therein, the purpose of which will become apparent as the description of the cutter 32 proceeds. There is also a thin slot 38 formed in the ring member 34, the slot 38 being formed along a plane generally transverse with respect to the opening 36.

Figure 4:
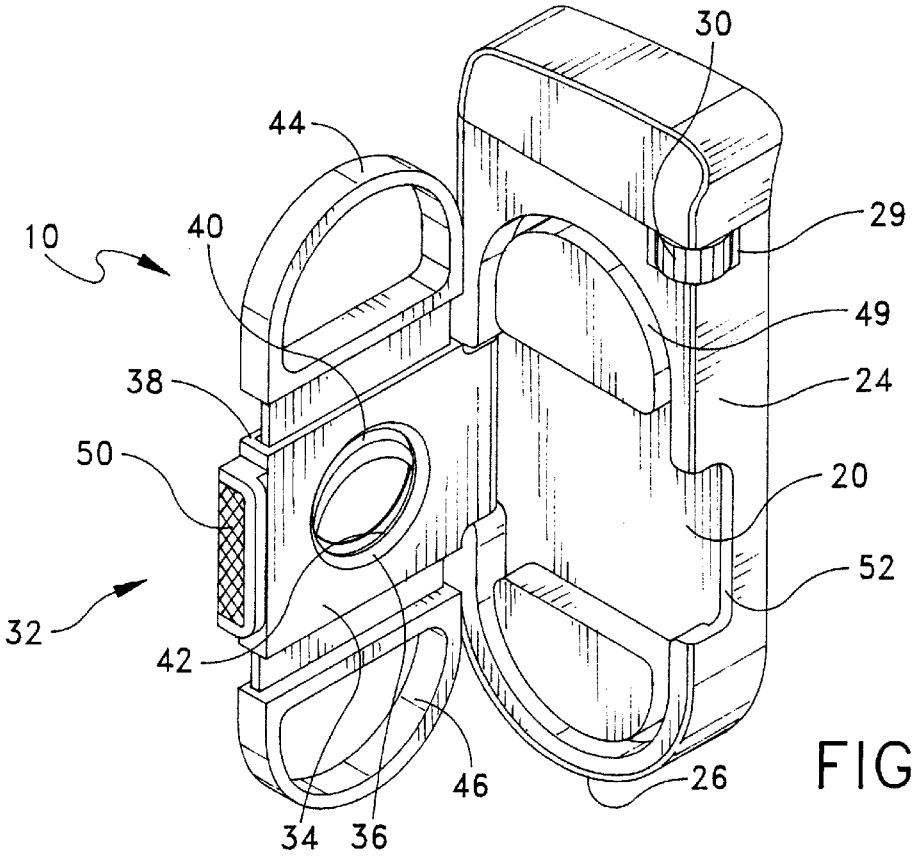
FIG. 4 is a perspective view showing the cigar cutter swung to an open position with the dual cutting blades in an open position.

Turning now to FIGS. 2 and 4, received within the thin slot 38 of the ring member 34 are a pair of cutting blades, indicated at 40 and 42, that are movable between a first position in which the cutting blades 40 and 42 are substantially removed from the slot 38 (FIG. 4) and a second position in which the cutting blades 40 and 42 are completely received within the slot 38 (FIG. 2). The cutting blades 40 and 42 are of standard construction, each having a sharp cutting edge 43 which, when cutting the head portion of the cigar 12, produces a clean cut. A pair of oppositely positioned handle portions 44 and 46 are provided on the outer end of each cutting blade for enabling the smoker to easily move the blades 40 and 42 between the first and second positions. The arrangement is such that the smoker moves the handle portions 44 and 46 from the second position to the first position and disposes the head portion of the cigar 12 in the large opening 36 of the ring member 34. Upon moving the handle portions 44 and 46 of the cutting blades 40 and 42 to the second position, the head portion of the cigar 12 is sheared off or cut and ready to be smoked. Friction means releasably maintain the cutting blades 40 and 42 in the second position received within the slot 38 of the ring member 34 until the handle portions 44 and 46 are pulled outwardly to the first position by a nominal force.

Figure 3:
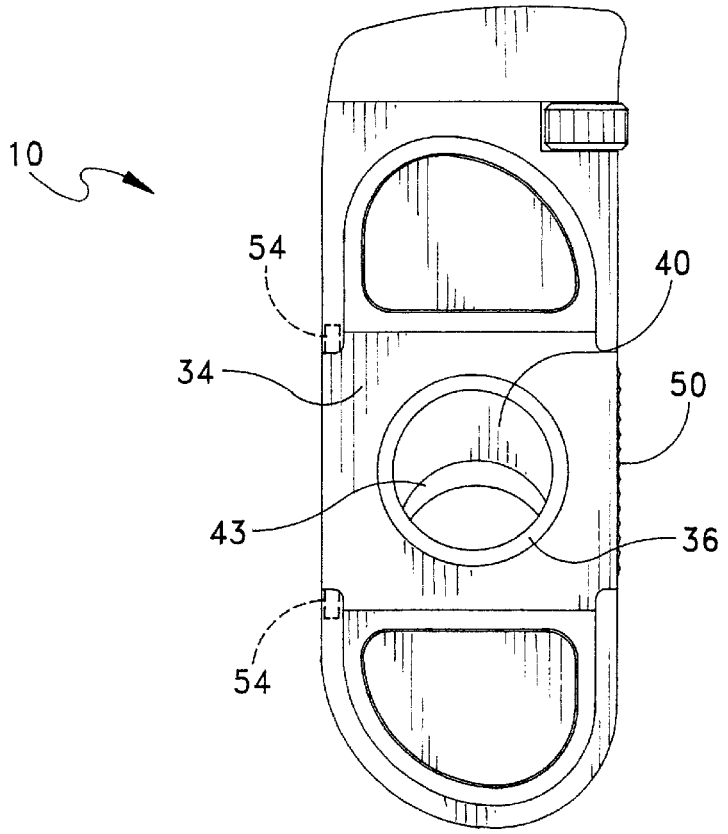
FIG. 3 is a front elevational view showing the cigar cutter in a closed position stowed within the cavity of the lighter casing.

Referring to FIGS. 1 and 3, the ring member 34 of the cutter 32 is secured to the casing 14 in a position in which the ring member 34 is disposed within a cavity 48 formed in one of the walls (e.g., wall 18) of the casing 14. In the present invention, the ring member 34 is hingedly attached to the casing 14, about a vertical axis located adjacent an edge of wall 18 so that the cutter 32 can be swung outwardly in a sidewise direction, which is important, where a double cutter is involved, to permit access to and operation of handle portions 44 and 46. As shown, the ring member 34 is hingedly connected adjacent side wall 22 between a closed position in which the ring member 34 is received within the cavity 48 of the casing 14 (FIG. 1 and 3) and an open position in which the ring member 34 is pivoted away from the casing 14 (FIG. 2 and 4). The ring member 34 is further provided with a projecting gripping surface 50 which fits in a cut out 52 formed in the side wall 24 of the casing 14 for gripping the ring member 34 and moving the cutter 32 to the open position.

The ring member 34 is pivotally attached to the casing 14 by a pair of oppositely projecting pins (see FIG. 3), each indicated at 54. Each pin 54 is received within an aperture formed in the side wall 22 for achieving the pivotal movement of the ring member 34 with respect to the body 16 of the casing 14 between the open and closed positions. In order to releasably maintain the cigar cutter 32 in the stowed position within the cavity 48 of the casing 14, a frictional interlocking fit is provided between the cigar cutter 32 and cavity 48 in body 16 of the lighter 10.

It should also be noted that the handle portions 44 and 46 are of semi-circular open configuration, and that cavity 48 has channels 49 that snugly receive the handle portions. This arrangement precludes any undesired movement of cutting blades 40 and 42, when cutter 32 is in its stowed position, and further maintains the desired flush relationship between cutter 32 and wall 18 when the cutter is in its stowed position.

Figure 5:
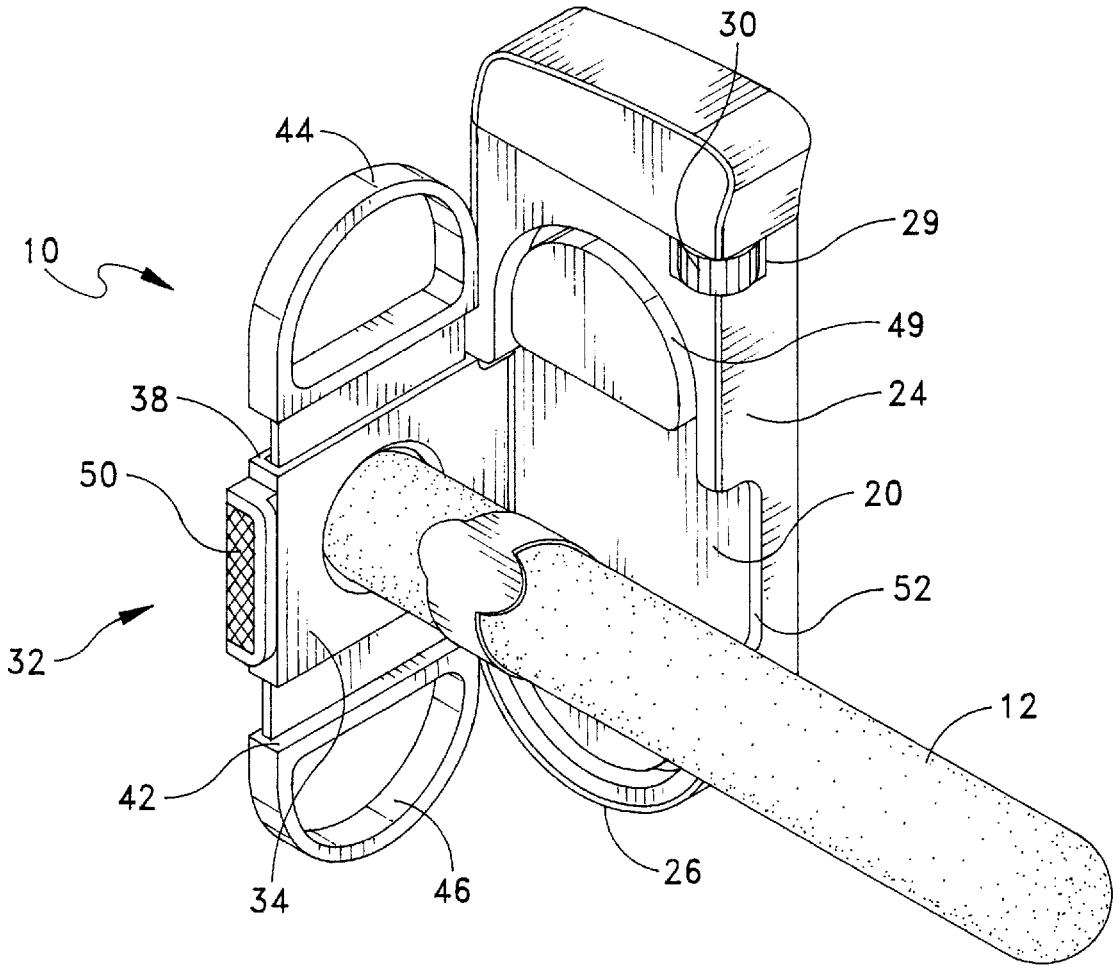
FIG. 5 is a perspective view showing a cigar being received within an opening of the cigar cutter prior to cutting.

The operation of the device 10 is as follows. In order to move the cutter 32 from the closed position depicted in FIGS. 1 and 3 to the open position depicted in FIGS. 2 and 4, a nominal force is applied to the gripping surface 50 of the ring member 34 for moving the cutter 32 away from the casing 14 about its vertical axis. For operating the cutter 32, the handle portions 44 and 46 of the cutting blades 40 and 42 are pulled outwardly to the first position. At this point, the head portion of the cigar 12 is disposed within the large opening 36 of the ring member 34, as shown in FIG. 5, and the handle portions 44 and 46 are then moved back to the second position. This action forces the cutting blades 40 and 42 inwardly which achieves the severing or cutting of the head portion of the cigar 12 so that the cigar can be smoked.

After removing the head portion of the cigar 12, the cutter 32 is hingedly moved back to the closed position so that the device 10 can be safely used to light the cigar 12 by the smoker. This is realized by opening the cover 28 and rotating the spark producing wheel 30 for producing a flame in a conventional manner. Once the cigar 12 is lighted by the smoker, the cover 28 can be returned to its closed position.

Thus, it should be observed that the device 10 disclosed herein provides an effective and efficient means for both cutting off the head portion of the cigar 12 and lighting the same without having two separate and distinct components for achieving these two functions. Also, the cutting action comprises oppositely moving cutting blades which more effectively shear off the closed head of the cigar. It can therefore be seen that for these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A combination lighter and cigar cutter device for cutting off an end of a cigar and lighting same, said device comprising:

a casing having a body, lighting means for producing a flame, and a recessed cavity formed in the body;

a cigar cutter having a planar ring member with a central opening and a thin slot formed therein, said thin slot being formed within the ring member along a plane generally transverse with respect to the opening, and a pair of cutting blades received within the thin slot of the ring member, said blades movable between a first position in which the blades are substantially withdrawn from the opening and a second position in which the blades are completely received within the opening so as to effect a shearing or cutting action on a cigar positioned in said central opening, each blade having a handle portion attached thereto for easily moving the blades between the first and second positions; and means for securing the ring member of the cigar cutter to the casing in a position in which the cutter is snugly disposed within the cavity so as to form a substantially flush continuation of the body surface in which the cavity is located, said securing means comprising hinge means having a vertical axis when the lighter and cutter device is in an upright disposition, whereby said cutter may be swung outwardly in a sidewise direction to permit access to and operation of said handle portions.

2. In the device of claim 1, said ring member having a gripping surface located on the end of said ring member opposite to the location of said vertical axis, and means exposing said gripping surface to facilitate access thereto when it is desired to swing said ring member to its outward position, said exposing means comprising a cut-out in the casing adjacent to the location of said gripping surface.

3. In the device of claim 1, said handle portions comprising open loops, said cavity having channels for snugly receiving said loops, whereby when said ring member is positioned within said cavity, movement of said handle portions is precluded.

* * * * *